US006474947B1

(12) United States Patent
Yuri

(10) Patent No.: US 6,474,947 B1
(45) Date of Patent: Nov. 5, 2002

(54) FILM COOLING HOLE CONSTRUCTION IN GAS TURBINE MOVING-VANES

(75) Inventor: Masanori Yuri, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/807,748

(22) PCT Filed: Sep. 16, 1999

(86) PCT No.: PCT/JP99/05047

§ 371 (c)(1),
(2), (4) Date: Apr. 18, 2001

(87) PCT Pub. No.: WO01/20133

PCT Pub. Date: Sep. 16, 1999

(30) Foreign Application Priority Data

Mar. 13, 1998 (JP) ..... 10-063021
Mar. 16, 1998 (JP) ..... 10-065522

(51) Int. Cl.[7] ..... F01D 5/18
(52) U.S. Cl. ..... 416/97 R
(58) Field of Search ..... 416/97 R; 415/115, 415/116, 117

(56) References Cited

U.S. PATENT DOCUMENTS 4,456,428 A * 6/1984 Cuvillier ..... 416/97 R
4,992,026 A * 2/1991 Ohtomo et al. ..... 416/97 R
5,536,143 A * 7/1996 Jacala et al. ..... 416/96 R
5,779,438 A * 7/1998 Wilfert ..... 415/115
5,902,093 A * 5/1999 Liotta et al. ..... 416/97 R
6,200,087 B1 * 3/2001 Tung et al. ..... 415/115
6,206,638 B1 * 3/2001 Glynn et al. ..... 416/97 R
6,331,098 B1 * 12/2001 Lee ..... 416/97 R

FOREIGN PATENT DOCUMENTS

| | | |
|---|---|---|
| EP | 0 383 046 | 8/1990 |
| GB | 1 350 424 | 4/1974 |
| JP | 52-77914 | 6/1977 |
| JP | 61-89901 | 5/1986 |
| JP | 62-228603 | 10/1987 |
| JP | 7-63002 | 3/1995 |
| JP | 8-158803 | 6/1996 |
| JP | 11-257005 | 9/1999 |

* cited by examiner

*Primary Examiner*—John E. Ryznic
(74) *Attorney, Agent, or Firm*—Wenderoth, Lind & Ponack, L.L.P.

(57) ABSTRACT

The interior of a gas turbine moving blade is sectioned by a rib into cooling passage portions. Cooling air enters one of the cooling passage portions and turns to flow into the other cooling passage portion. A stagnation area occurs in an end corner portion of the one cooling passage portion, but a cooling hole is provided so that air flow comes outside of the blade through the cooling hole, and thus cooling air flow occurs thereat. Also, a separation area occurs in a tip end portion of the rib due to separation of air flow, but another cooling hole is provided so that air flow comes outside of the blade and cooling air flow occurs thereat. Further, in a gas turbine moving blade having turbulators provided in multi-stages on a cooling passage inner wall, a film cooling hole structure for eliminating separation of cooling air flow between the turbulators is also provided.

2 Claims, 7 Drawing Sheets

Fig. 5 (a) (Prior Art)
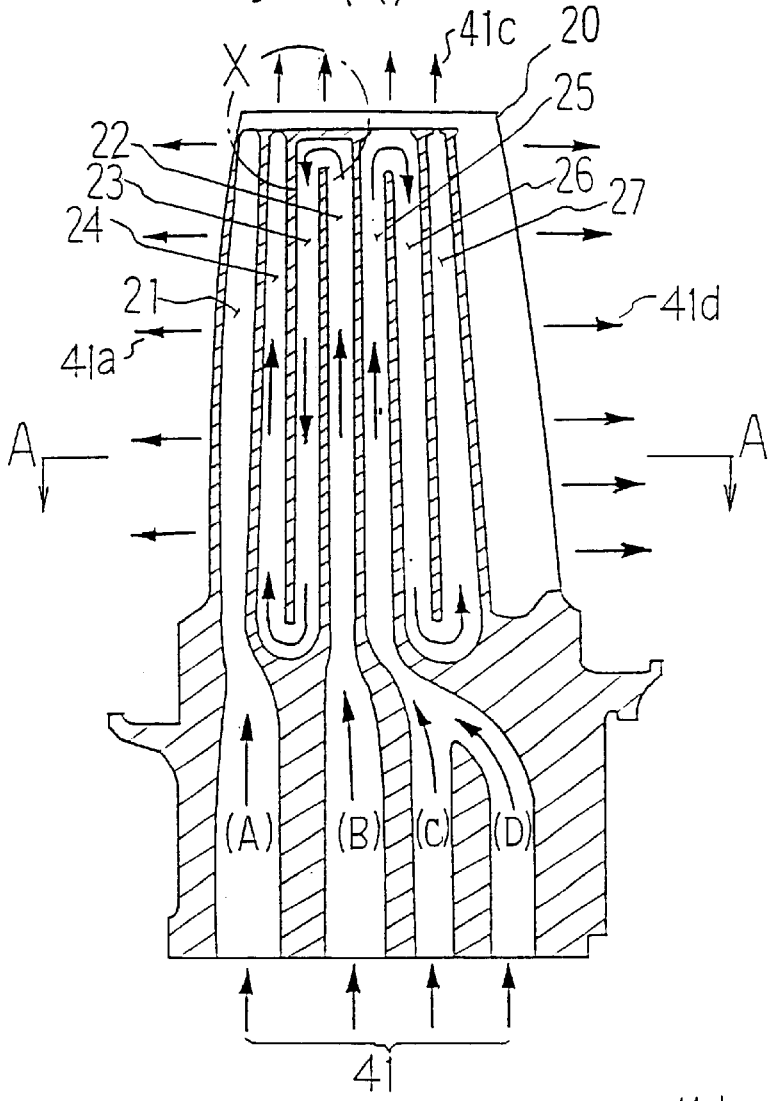
Fig. 5 (b) (Prior Art)
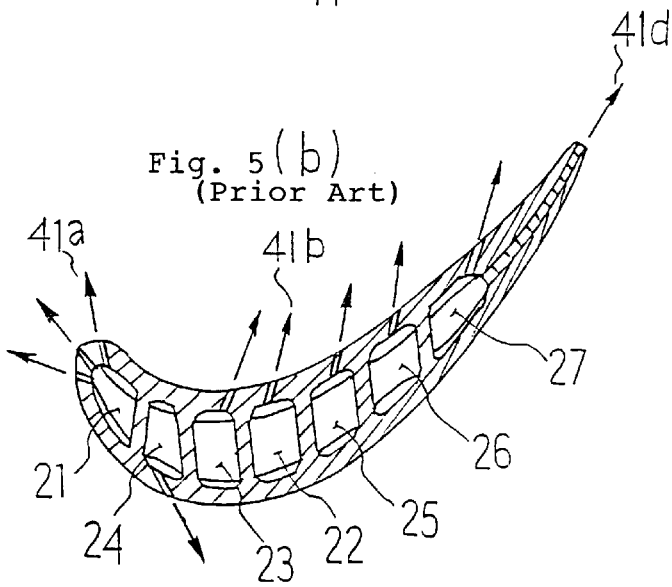

Fig. 6 (a) (Prior Art)
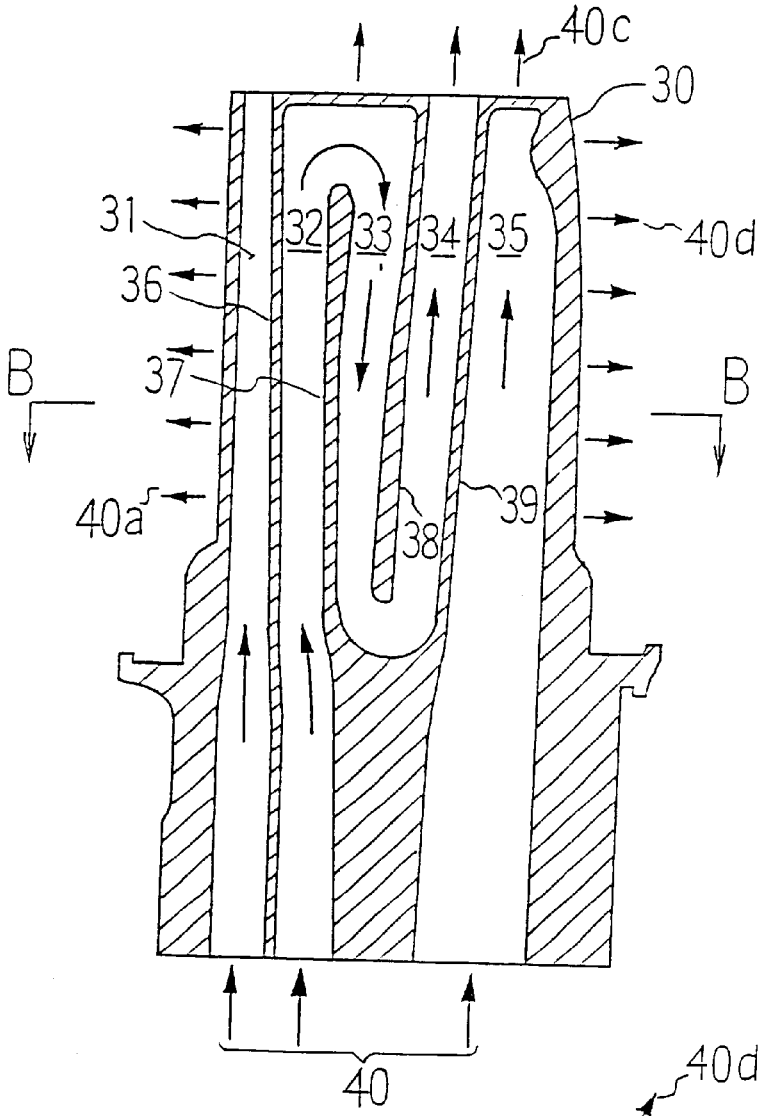
Fig. 6(b) (Prior Art)
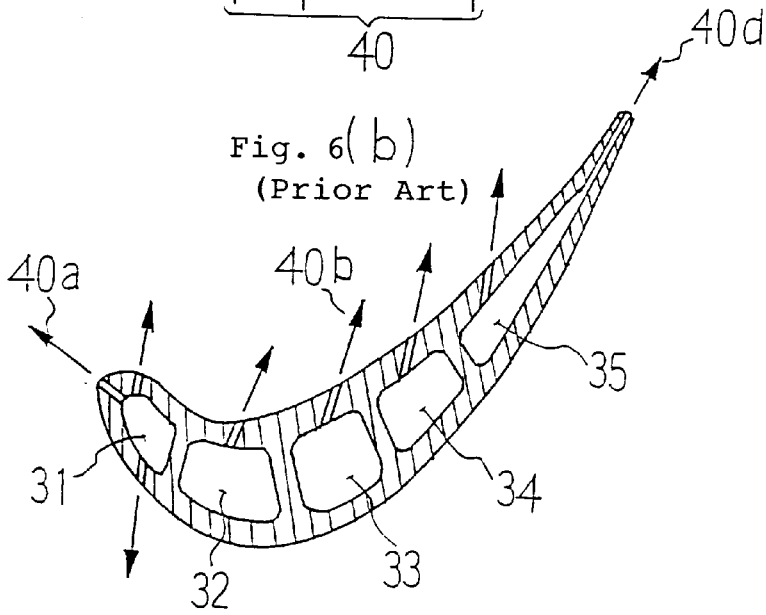

FILM COOLING HOLE CONSTRUCTION IN GAS TURBINE MOVING-VANES

BACKGROUND OF THE INVENTION

1. Field of the Invention

The present invention relates to a film cooling hole structure of a gas turbine moving blade in which arrangement of film cooling holes is optimized so as to enhance a cooling efficiency of the moving blade.

2. Description of the Prior Art

In a gas turbine moving blade known in the art, cooling air is flown in a serpentine cooling passage provided in the blade for effecting a convection cooling, and also cooling air is injected from film cooling holes onto a blade outer surface for effecting a film cooling.

FIGS. 6(*a*) and 6(*b*)are cross sectional views of one example of a gas turbine moving blade cooling structure in the prior art, wherein FIG. 6(*a*) shows an entire portion of the cooling structure and FIG. 6(*b*) shows a cross sectional view taken on line B—B of FIG. 6(*a*). In FIG. 6(*a*), numeral 30 designates a moving blade, whose interior is sectioned by ribs 36, 37, 38, 39 to form a leading edge side cooling passage 31, a serpentine cooling passage comprising cooling passage portions 32, 33, 34 in a blade central portion, and a trailing edge side cooling passage 35, when the passage portions 32, 33, 34 communicate with each other in this order.

Cooling air represented by arrows 40 in a blade base portion enters the cooling passages, wherein the cooling air flowing in the leading edge side cooling passage 31 cools a blade leading edge portion and flows out of leading edge side holes as represented by arrows air 40a, the cooling air flowing in the cooling passage portions 32, 33, 34 cools the blade central portion and flows out of film cooling holes provided in a blade surface for effecting a film cooling of the blade surface as air represented by arrows 40*b,* and the cooling air flowing in the trailing edge side cooling passage 35 cools a blade trailing edge portion and flows out of a blade tip portion as represented by arrows air 40*c* and also flows out of a multiplicity of cooling holes provided in a blade trailing edge as air represented by arrows 40*d.*

FIGS. 5(*a*) and 5(*b*) are cross sectional views of another example of a gas turbine moving blade cooling structure in the prior art, wherein FIG. 5(*a*) shows an entire portion of the cooling structure and FIG. 5(*b*) shows a cross sectional view taken on line A—A of FIG. 5(*a*). In FIG. 5(*a*), numeral 20 designates a moving blade, whose interior is sectioned to form a leading edge side cooling passage 21, a serpentine cooling passage comprising cooling passage portions 22, 23, 24, and a serpentine cooling passage comprising cooling passage portions 25, 26, 27 on a rear side-thereof, wherein the cooling passage portions 22, 23, 24 and 25, 26, 27 communicate with each other in this order, respectively.

Cooling air represented by arrows 41 in a blade base portion enters the cooling passages, wherein the cooling air entering passage (A) flows into the leading edge side cooling passage 21 and flows out of leading edge side holes as air represented by arrows 41*a,* the cooling air entering passage (B) flows into the cooling passage portion 22 to then flow through the cooling passage portions 23, 24 and flows out of film cooling holes provided in a blade tip portion as air represented by arrows 40*b,* and the cooling air entering passages (C), (D) flows into the cooling passage portion 25 to then flow through the cooling passage portions 26, 27 and flows out of a multiplicity of cooling holes of a blade trailing edge portion as air represented by arrows 41*d.* Thus, the blade is so constructed as to be cooled effectively in its entirety.

FIG. 4 is an enlarged explanatory view of portion x of FIG. 5(*a*) showing a film cooling hole structure in a cooling passage turning portion of the gas turbine moving blade in the prior art. The cooling passage portions 22, 23 are sectioned by a rib 51 and communicate with each other at a turning portion in the blade tip portion. In the blade tip portion, there are provided a multiplicity of film cooling holes 50. When the cooling air represented by arrow 41 flowing in the cooling passage portion 22 flows into the adjacent cooling passage portion 23 sectioned by the rib 51 as shown by arrow 41*e,* it does not flow along the rib 51 in the turning portion but separates therefrom as shown by arrow 41*f,* which results in causing a separation area 52 where a heat transfer rate is reduced. Further, as shown by arrow 41*g,* there arises a stagnation area 53 in a corner of the cooling passage portion 22, and the heat transfer rate is low in the stagnation area 53 also. Thus, there is caused a cooling non-uniformity in the cooling passage.

In the mentioned prior art gas turbine moving blades of FIGS. 5(*a*), 5(*b*), 6(*a*) and 6(*b*), there are provided the leading edge side cooling passage, the serpentine cooling passage of the blade central portion and the trailing edge side cooling passage and the cooling air is flown therethrough for blade cooling and the cooling air is also injected from the film cooling holes onto the blade outer surface for effecting a film cooling. However, the positions of the film cooling holes are not necessarily optimized, so that there arises the stagnation area of the cooling air in the cooling passage and also there is caused the separation phenomenon of the cooling air from the rib surface in the turning portion of the serpentine cooling passage. The stagnation area and separation area are areas where the heat transfer rate is reduced, thereby the cooling of the blade interior becomes non-uniform and this is one of the reasons for the cooling efficiency being reduced.

Thus, the present invention is made with a first object to provide a gas turbine moving blade cooling structure in which film cooling holes provided in a cooling passage are devised to be arranged so as to eliminate a stagnation area and a separation phenomenon of cooling air to thereby realize a uniform cooling in the cooling passage, and to enhance a cooling efficiency by eliminating an area where a heat transfer rate is low.

FIGS. 8(*a*) and 8(*b*) are cross sectional views of still another example of a gas turbine moving blade cooling structure in the prior art, wherein FIG. 8(*a*) shows an entire portion of the cooling structure and FIG. 8(*b*) shows a cross sectional view taken on line B—B of FIG. 8(*a*). In FIG. 8(*a*), numeral 30 designates a moving blade, whose interior is sectioned by ribs 36, 37, 38, 39 to form a leading edge side cooling passage 31, a serpentine cooling passage comprising cooling passage portions 32, 33, 34 in a blade central portion, and a trailing edge side cooling passage 35, wherein the cooling passage portions 32, 33, 34 communicate with each other in this order. In each of these cooling passages, there are provided turbulators 48 for making a flow of cooling air therein turbulent to accelerate a convection to thereby enhance a heat transfer effect of the cooling air.

Cooling air represented by arrows 40 in a blade base portion enters the cooling passages, wherein the cooling air flowing in the leading edge side cooling passage 31 cools a blade leading edge portion and flows out of leading edge side holes as air represented by arrows 40*a,* the cooling air flowing in the cooling passage portions 32, 33, 34 cools the blade central portion and flows out of film cooling holes provided in a blade surface for effecting a film cooling of the blade surface as air represented by arrows 40*b,* and the cooling air flowing in the trailing edge side cooling passage 35 cools a blade trailing edge portion and flows out of a blade tip portion as air represented by arrows 40*c* and also flows out of a multiplicity of cooling holes provided in a blade trailing edge as air represented by arrows 40*d*.

FIGS. 7(*a*) and 7(*b*) are cross sectional views of still another example of a gas turbine moving blade cooling structure in the prior art, wherein FIG. 7(*a*) shows an entire portion of the cooling structure and FIG. 7(*b*) shows a cross sectional view taken on line A—A of FIG. 7(*a*). In FIG. 7(*a*), numeral 20 designates a moving blade, whose interior is sectioned to form a leading edge side cooling passage 21, a serpentine cooling passage comprising cooling passage portions 22, 23, 24, and a serpentine cooling passage comprising cooling passage portions 25, 26, 27 on a rear side thereof, wherein the cooling passage portions 22, 23, 24 and 25, 26, 27 communicate with each other in this order, respectively. In this example also, like in the moving blade shown in FIGS. 8(*a*) and 8(*b*), there are provided turbulators 28 in each of the cooling passages so as to enhance a heat transfer effect of the cooling air.

cooling air represented by arrows 41 in a blade base portion enters the cooling passages, wherein the cooling air entering passage (A) flows into the leading edge side cooling passage 21 and flows out of leading edge side holes as air represented by arrows 41*a,* the cooling air entering passage (B) flows into the cooling passage portion 22 to then flow through the cooling passage portions 23, 24 and flows out of film cooling holes provided in a blade tip portion as air represented by arrows 41*b,* and the cooling air entering passages (C), (D) flows into the cooling passage portion 25 to then flow through the cooling passage portions 26, 27 and flows out of a multiplicity of cooling holes of a blade trailing edge as represented by arrows air 41*d.* Thus, the blade is so constructed as to be cooled effectively in its entirety.

In the mentioned prior art gas turbine moving blades of FIGS. 7(*a*), 7(*b*), 8(*a*) and 8(*b*) there are provided the leading edge side cooling passage, the serpentine cooling passage of the blade central portion and the trailing edge side cooling passage, wherein the turbulators are provided in each of the cooling passages, and the cooling air is flown therethrough for blade cooling and the cooling air is also injected from the film cooling holes onto the blade outer surface for effecting a film cooling. However, the positions of the film cooling holes are not necessarily optimized, so that there arises a separation area of the cooling air flow immediately after each of the turbulators in the cooling passage, and this separation area is an area where a heat transfer rate is reduced to thereby make the blade cooling non-uniform, which is one of the reasons for the cooling efficiency being reduced.

Thus, the present invention is made with a second object to provide a gas turbine moving blade cooling structure in which film cooling holes provided in cooling passages are devised to be arranged so as to eliminate a separation phenomenon of cooling air caused between each of turbulators, to thereby realize a uniform cooling in the cooling passages and to enhance a cooling efficiency by eliminating an area where a heat transfer rate is low.

SUMMARY OF THE INVENTION

In order to achieve the first object, the present invention provides the following.

A film cooling hole structure of a gas turbine moving blade is constructed such that an interior of the blade is sectioned by a rib into cooling passage portions communicating with each other so as to form a serpentine cooling passage. Cooling air for blade cooling is flown in the serpentine cooling passage to be flown out of the blade through film cooling holes. Two mutually adjacent cooling passage portions so sectioned by the rib are a cooling air flow upstream side passage and a cooling air flow downstream side passage. A portion of the film cooling holes is provided in an end corner portion of the cooling air flow upstream side, passage and a portion of said film cooling holes is provided at a position close to or in contact with a tip portion of the rib in the cooling air flow downstream side passage.

In the present invention, because a portion of the film cooling holes is provided in the end corner portion of the cooling passage portion on the cooling air flow upstream side of the two mutually adjacent cooling passage portions sectioned by the rib, the cooling air entering a stagnation area of the cooling air flow in this end corner portion flows outside of the blade through the film cooling holes provided thereat, so that cooling air flow occurs in the stagnation area and the heat transfer rate can be enhanced in the stagnation area in the end corner portion.

Further, there is formed a turning portion of the cooling air passage between the cooling air flow upstream side passage and the cooling air flow downstream side passage. In the cooling air flow downstream side passage, especially in the rib tip portion, the cooling air does not flow along the rib surface but separates therefrom, hence a separation area occurs in the rib tip portion and the cooling air flow therein becomes worse. Thus, in the present invention, in addition to the above-mentioned stagnation area, because a portion of the film cooling holes is provided in the separation are; that is, at the position close to or in contact with the rib tip portion, the cooling air flows outside of the blade through the film cooling holes provided thereat, so that cooling air flow occurs in the separation area and the heat transfer rate can be enhanced in the separation area.

The above-mentioned portion of the film cooling holes may be provided newly in the stagnation area and the separation area, or a portion of the film cooling holes provided conventionally may be moved to these areas, thereby such a low heat transfer area as the stagnation area or the separation area is eliminated and a uniform cooling of the moving blade and a longer life thereof can be attained.

Also, in order to achieve the second object, the present invention provides the following.

A film cooling hole structure of a gas turbine moving blade is constructed such that an interior of the blade is sectioned by a rib into cooling passage portions communicating with each other so as to form a serpentine cooling passage. Turbulators are provided on an inner wall of the serpentine cooling passage, and are arranged in multi-stages so as to cross a cooling air flow direction. cooling air for blade cooling is flown in the serpentine cooling passage to be flown out of the blade through a film cooling hole provided between each of the turbulators. The width of each of the turbulators is e and distance between a cooling air flow downstream side surface of each of the turbulators and a center of the film cooling hole downstream thereof is d. The film cooling hole positions between each of the turbulators are such that d/e is larger than 0 and smaller than 2 ($0<d/e<2$).

In the present invention, the film cooling hole is arranged so that d/e is larger than 0 and smaller than 2 ($0<d/e<2$); that is, the film cooling hole is provided close to or in contact with the rear side of the turbulator in the cooling air flow direction. Hence, a separation phenomenon of the cooling air flow wherein the cooling air is entrained reversely toward the rear side of the turbulator to separate from the wall surface can be eliminated. That is, because the film cooling hole is provided in a separation area, which is a low heat transfer area, caused by separation of the air flow in the vicinity of the rear side of the turbulator, the cooling air flows in the separation area to flow outside of the blade through the film cooling hole to accelerate a convection of the cooling air. Thus, the heat transfer rate is enhanced in the separation area and the cooling passage can be cooled uniformly.

Also, the present invention is made by combining the film cooling hole structure of the first object and the film cooling hole structure of the second object, to thereby provide a film cooling hole structure of a gas turbine moving blade which is able to achieve both of the first and second objects.

BRIEF DESCRIPTION OF THE DRAWINGS

FIGS. 5(*a*) and 5(*b*) are cross sectional views of one example of a gas turbine moving blade cooling structure in the prior art, wherein FIG. 5(*a*) shows an entire portion of the cooling structure and FIG. 5(*b*) shows a cross sectional view taken on line A—A of FIG. 5(*a*).

FIGS. 6(*a*) and 6(*b*) are cross sectional views of another example of a gas turbine moving blade cooling structure in the prior art, wherein FIG. 6(*a*) shows an entire portion of the cooling structure and FIG. 6(*b*) shows a cross sectional view taken on line B—B of FIG. 6(*a*).

DESCRIPTION OF THE PREFERRED EMBODIMENTS

Herebelow, embodiments according to the present invention will be described concretely with reference to the figures.

(First Embodiment)

Figure 1:
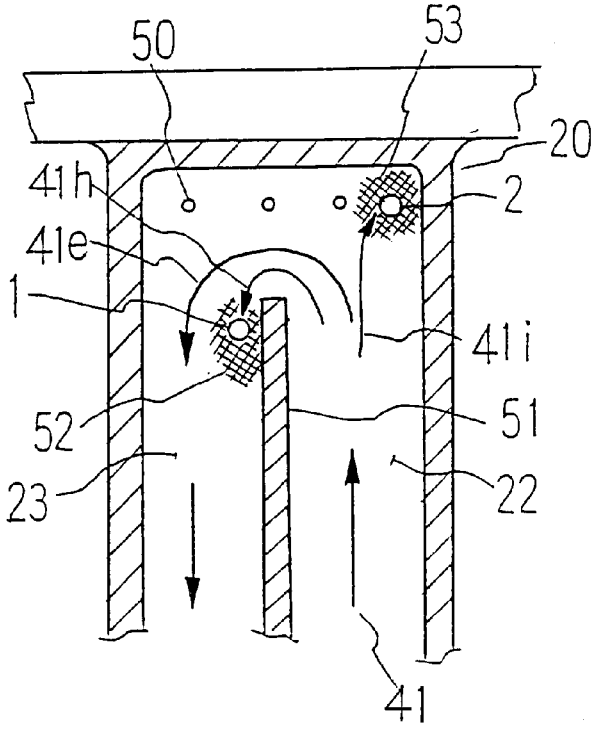
FIG. 1 is an enlarged explanatory view of a film cooling hole structure of a gas turbine moving blade of a first embodiment according to the present invention.
Figure 4:
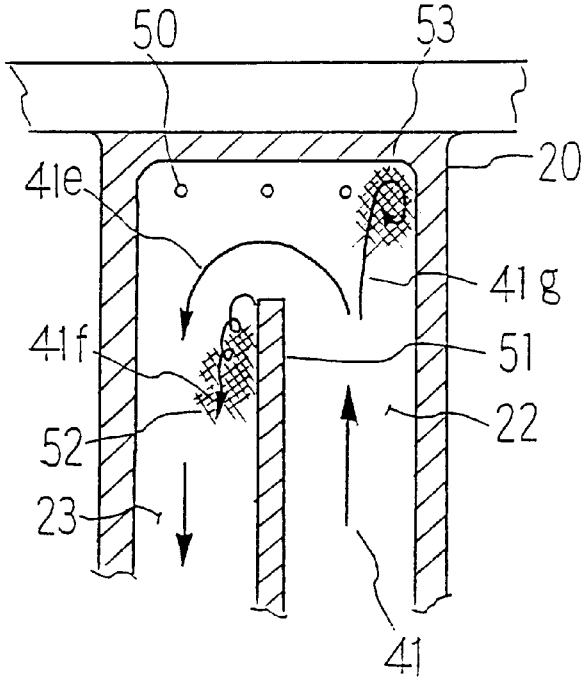
Fig. 4 (Prior Art)
FIG. 4 is an enlarged explanatory view of portion X of FIG. 5(*a*) showing a film cooling hole structure in a cooling passage turning portion in the prior art.

FIG. 1 is an enlarged explanatory view of a film cooling hole structure of a gas turbine moving blade of a first embodiment, which is shown in contrast with the prior art film cooling hole structure of FIG. 4 as portion X of the moving blade of FIG. 5(*a*).

In FIG. 1, the interior of a moving blade 20 is sectioned by a rib 51 to form cooling passage portions 22, 23 and cooling holes 50 are provided in a blade tip portion. This construction is same as that shown in FIG. 4. A featured portion of the present invention is cooling holes 1, 2 provided in the cooling passage as follows.

The cooling hole 1 is a hole for effecting a film cooling, which is provided at the separation area 52 caused by a separation phenomenon of cooling air flow in a tip portion of the rib 51 of the gas turbine moving blade in the prior art shown in FIG. 4. Also, the cooling hole 2 is provided at the stagnation area 53 caused in a corner of the cooling passage portion 22 in the prior art.

In the construction comprising the mentioned cooling holes 1, 2, cooling air 41 flowing through the cooling passage portion 22 turns as shown by arrow 41*e* to flow into the adjacent cooling passage portion 23. In this process of air flow, the air flow separated from the tip portion of the rib 51 enters the cooling hole 1 provided at the separation area 52 as shown by arrow 41*h*. The cooling hole 1 is provided closely to or in contact with the tip portion of the rib 51 so as to be positioned in the area where the separation of air occurs to prevent a flow thereof, hence the cooling air 41*h* flows through this area to cool the separation area 52 effectively and the heat transfer rate thereat can be enhanced.

Also, the cooling air 41 partially flows to the stagnation area 53 in a tip corner portion of the cooling passage portion 22 and as the cooling hole 2 is provided in the stagnation area 53, the cooling air flows through the stagnation area 53, as shown by arrow 41*i*, to flow out of the blade. Hence, the cooling air flow arises in the stagnation area to cool this portion effectively and the heat transfer rate thereat can be enhanced.

It is to be noted that the mentioned cooling holes 1, 2 may be provided newly in the separation area and the stagnation area or a portion of the film cooling holes provided conventionally may be moved to these areas to form the cooling holes 1, 2, and either way thereof may be employed as a matter of course.

According to the present first embodiment as described above, the cooling hole 1 is provided in the separation area 52 on the cooling passage portion 23 side in the turning portion of the cooling passage at the tip portion of the rib 51 between the cooling passage portions 22, 23 of the gas turbine moving blade in the prior art, and the cooling hole 2 is provided in the stagnation area 53 in the tip corner portion of the cooling passage portion 22. Accordingly, the heat transfer rate in the respective areas is enhanced, the cooling of the entire blade is made uniform and a reduction of the cooling air quantity and a life elongation of the blade can be realized.

(Second Embodiment)

Figure 2A:
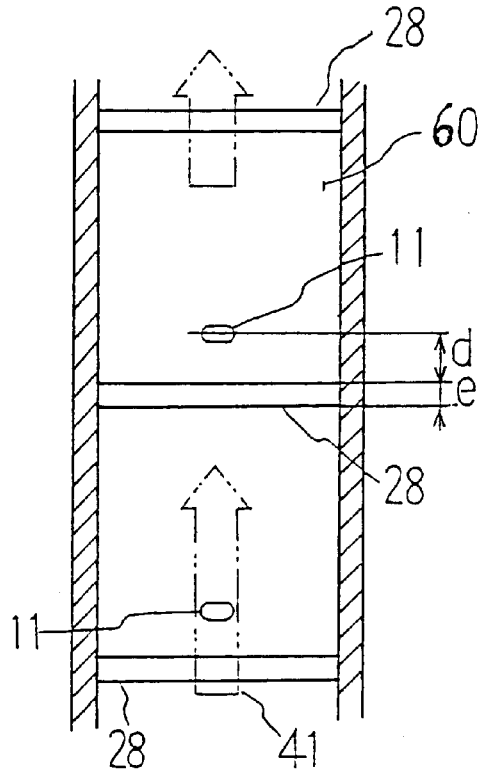
FIGS. 2(*a*) and 2(*b*) are cross sectional plan views of another film cooling hole structure of a gas turbine moving blade, wherein FIG. 2(*a*) shows a second embodiment according to the present invention and FIG. 2(*b*) shows a film cooling hole structure in the prior art applied to the moving blade shown in FIG. 7(*b*).
Figure 2B:
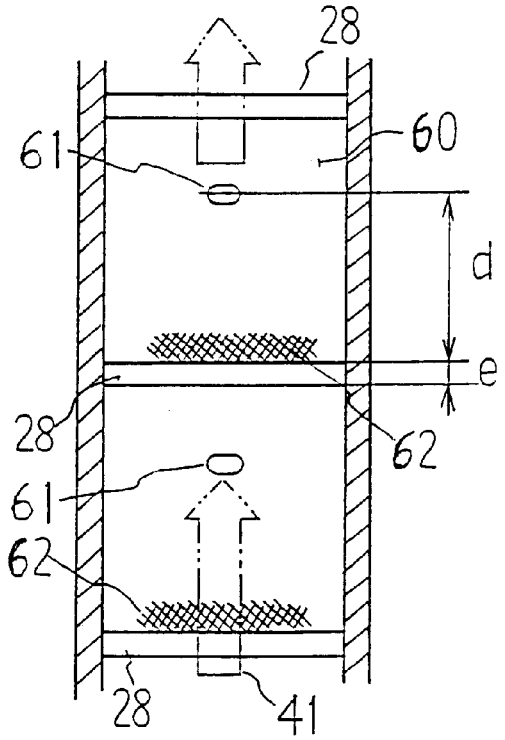
Fig. 2(b) (Prior Art)
Figure 7A:
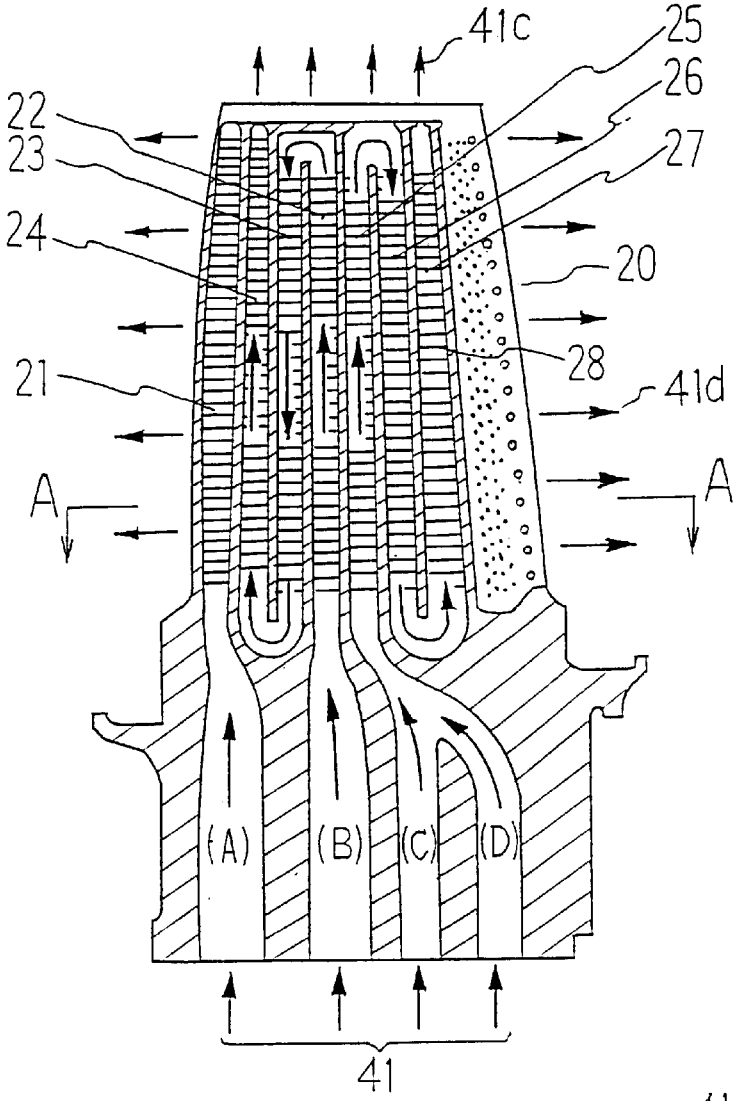
Fig. 7(a) (Prior Art)
FIGS. 7(*a*) and 7(*b*) are cross sectional views of still another example of a gas turbine moving blade cooling structure in the prior art, wherein FIG. 7(*a*) shows an entire portion of the cooling structure and FIG. 7(*b*) shows a cross sectional view taken on line A—A of FIG. 7(*a*).
Figure 7B:
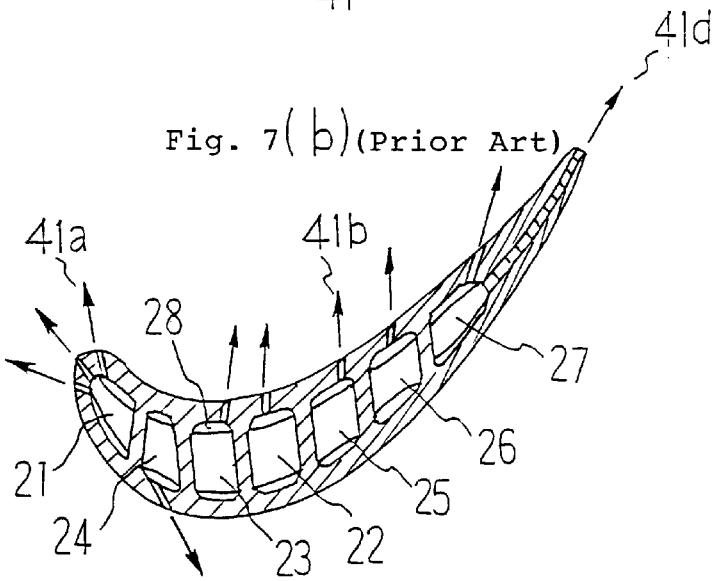
Fig. 7(b) (Prior Art)
Figure 8A:
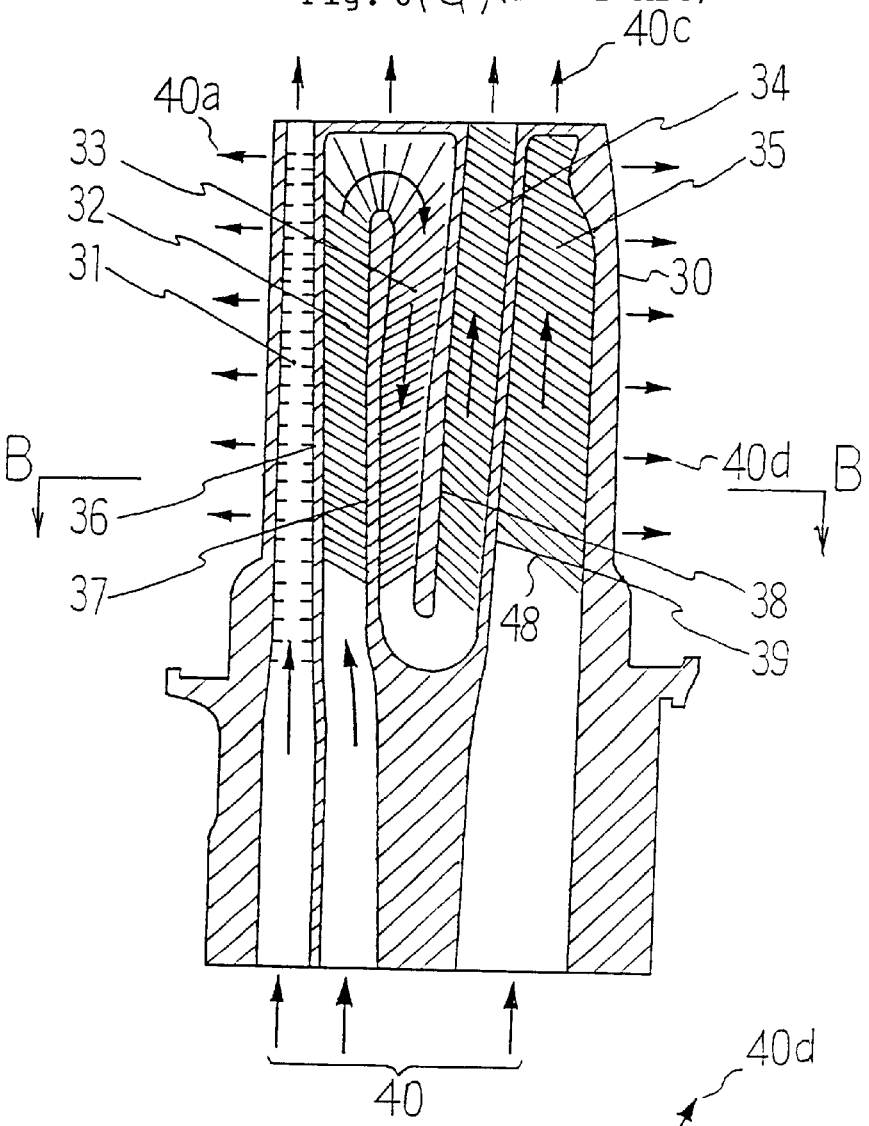
Fig. 8(a) (Prior Art)
FIGS. 8(*a*) and 8(*b*) are cross sectional views of still another example of a gas turbine moving blade cooling structure in the prior art, wherein FIG. 8(*a*) shows an entire portion of the cooling structure and FIG. 8(*b*) shows a cross sectional view taken on line B—B of FIG. 8(*a*).
Figure 8B:
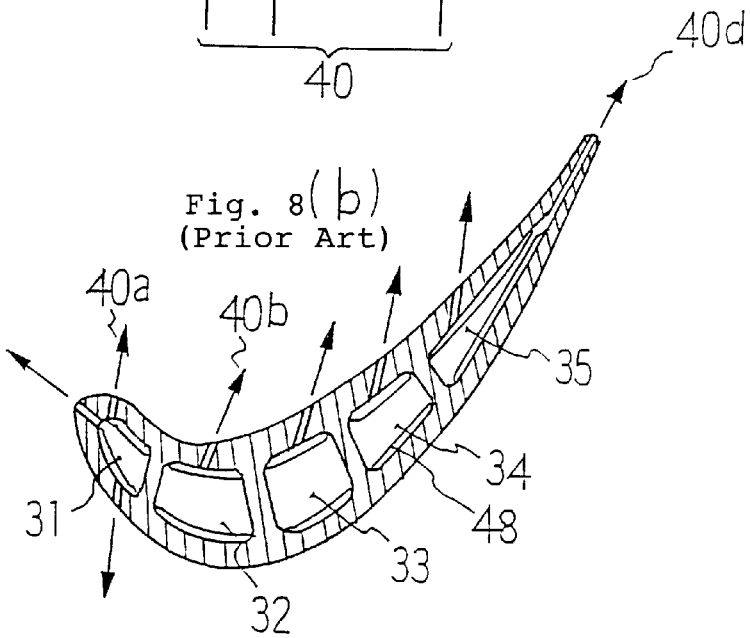
Fig. 8(b) (Prior Art)

FIGS. 2(*a*) and 2(*b*) are cross sectional plan views of another film cooling hole structure of a gas turbine moving blade, wherein FIG. 2(*a*) shows a second embodiment according to the present invention which is applied to the moving blade in the prior art shown in FIGS. 7(*a*) and 7(*b*), and FIG. 2(*b*) shows a film cooling hole structure of the moving blade in the prior art shown in FIGS. 7(*a*) and 7(*b*). Although description will be made on the example of the moving blade shown in FIGS. 7(*a*) and 7(*b*), the second embodiment may naturally be applied also to the moving blade in the prior art shown in FIGS. 8(*a*) and 8(*b*).

In FIG. 2(*b*), there are provided the turbulators 28 in plural stages on a cooling passage inner wall 60 and also provided is a film cooling hole 61 between each of the turbulators 28 so as to pass through the blade to open in a blade outer surface. Where width or thickness of the turbulator 28 is e and distance between a cooling air downstream side surface of the turbulator and a center of the film cooling hole 61 is d, there is no specific rule to decide the relationship between e and d in the present state of the film cooling hole but it is conventional to set d/e in a range of 10 to 20; that is, to provide the film cooling hole 61 around a central portion between each of the turbulators 28.

In the cooling passage so constructed, cooling air represented by arrow 41 flows in the passage to be made turbulent by the turbulators 28 to thereby cool the blade with an enhanced heat transfer rate, and the cooling air represented by arrow 41 is also ejected onto the blade outer surface from the film cooling holes 61 to thereby effect a film cooling of the blade surface. In this case, there occurs a separation phenomenon of the cooling air flow near each of the turbulators 28 on the downstream side thereof to form a separation area 62 thereat, as described later with respect to FIG. 3(*b*). This separation area 62 is an area where the heat transfer rate is reduced, so that the cooling of the cooling passage becomes non-uniform and an effective cooling cannot be achieved.

on the contrary, in the present second embodiment shown in FIG. 2(*a*), a film cooling hole 11 is provided close to or in contact with each of the turbulators 28 on the downstream side thereof such that $0<d/e<2$. Construction of other portions of the second embodiment is same as that of the cooling passage in the prior art shown in FIG. 2(*b*).

Generally, the flow separation area begins to be formed from when d/e is about 5, and this area is a low heat transfer area formed on a blade inner surface with the heat transfer rate being reduced by separation of the cooling air flow. Accordingly, if the film cooling hole 11 is provided at a position between a central portion of this low heat transfer area and a portion close to each of the turbulators 28; that is, a position where d/e is about 2 or less so that the cooling air may flow into this film cooling hole 11, then convection in this area is accelerated and the separation phenomenon can be dissolved effectively.

Figure 3A:
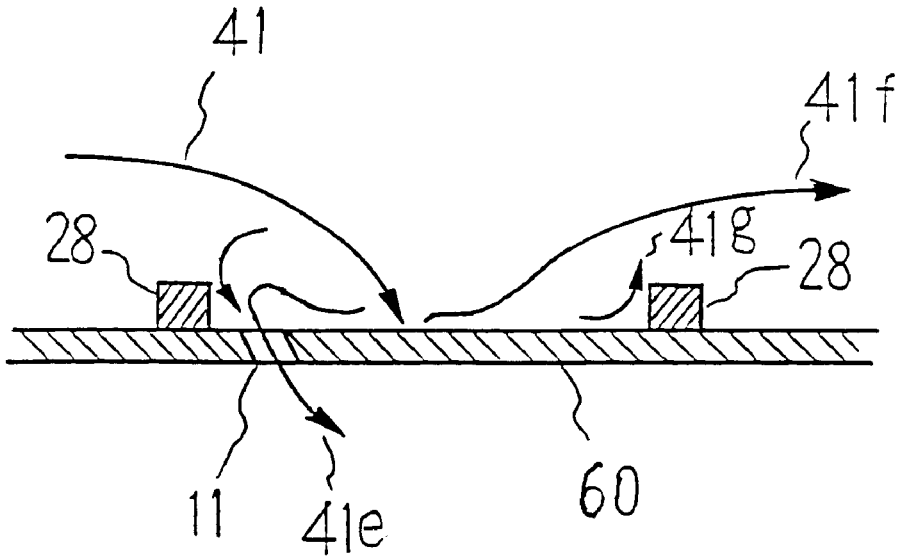
FIGS. 3(*a*) and 3(*b*) are explanatory cross sectional side views showing an arrangement of the film cooling hole of FIGS. 2(*a*) and 2(*b*) and a flow of cooling air therein, wherein FIG. 3(*a*) is of the second embodiment of FIG. 2(*a*), and FIG. 3(*b*) is of the prior art of FIG. 2(*b*).
Figure 3B:
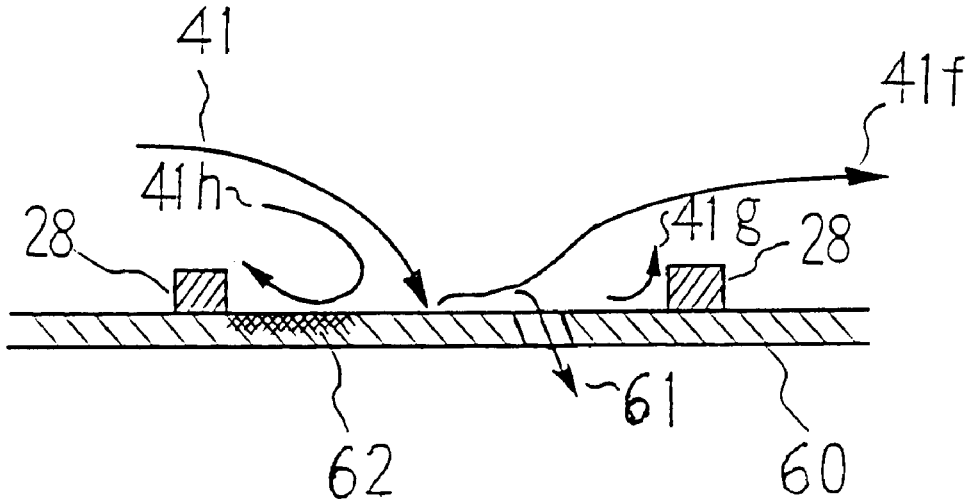
Fig. 3(b) (Prior Art)

Next, functions of the structure of the film cooling hole 11 mentioned above will be described with reference to FIGS. 3(*a*) and 3(*b*). FIGS. 3(*a*) and 3(*b*) are explanatory cross sectional side views showing an arrangement of the film cooling hole and a flow of the cooling air in a gas turbine moving blade, wherein FIG. 3(*a*) is of the second embodiment and FIG. 3(*b*) is of the prior art shown in FIG. 2(*b*).

In FIG. 3(*b*), the turbulators 28 are provided on the cooling passage inner wall 60 and the cooling air 41 strikes this inner wall 60 to then flow in a space downstream thereof as shown by arrow 41*f*. At this time, while air represented by arrow 41*g* near each of the turbulators 28 on an upstream side thereof flows to join in the air represented by arrow 41*f*, air near the turbulator 28 on a downstream side thereof turns like arrow 41*h* to cause the separation area 62 of air flow, and this separation area 62 becomes a low heat transfer area to make the cooling non-uniform, which is one of the reasons the cooling performance of the entire blade is reduced.

On the contrary, in the present second embodiment shown in FIG. 3(*a*), there is provided the film cooling hole 11 near each of the turbulators 28 on the downstream side thereof so as to be positioned in the separation area 62. Thus, the air that wants to separate flows through the film cooling hole 11 to flow out to the blade outer surface like air represented by arrow 41*e*, and by this cooling air flow caused in the separation area 62, the cooling effect in this portion can be enhanced.

According to the present second embodiment described above, the cooling air 41 strikes the blade inner wall to then flow over the turbulator 28 as the air represented by arrow 41*f* and cools the blade wall. On the other hand, the cooling air flows through the film cooling hole 11 provided near the turbulator 28 on the downstream side thereof to thereby accelerate a convection of the cooling air in the separation area 62 which would otherwise be caused, and the cooling effect in this area can be enhanced. Thus, the cooling in the cooling passage is performed uniformly and the cooling effect of the entire blade can be enhanced.

It is understood that while the invention has been described with respect to the embodiments as illustrated herein, it is not confined thereto but may be changed naturally with various modifications within the scope of the appended claims. For example, while the embodiments have been so described that the first object and the second object of the invention are solved separately, the first embodiment and the second embodiment may be employed to be combined so that the first object and the second object may be met at the same time.

What is claimed is:

1. A film cooling hole structure for a gas turbine blade having an interior which is sectioned by a rib into a cooling air flow upstream side passage and a cooling air flow downstream side passage that communicate with each other to define a serpentine cooling passage, comprising:

a film cooling hole in an end comer portion of the cooling air flow upstream side passage; and a film cooling hole in the cooling air flow downstream side passage and adjacent to a tip portion of the rib, such that when the gas turbine blade is to be cooled, cooling air is conveyed into the serpentine cooling passage and exits from said film cooling hole in the end comer portion of the cooling air flow upstream side passage and also from said film cooling hole in the cooling air flow downstream side passage adjacent to the tip portion of the rib.

2. The film cooling hole structure according to claim 1, wherein turbulators are arranged in multi-stages on an inner wall of the serpentine cooling passage so as to cross the cooling air when conveyed into the serpentine cooling passage, further comprising:

another film cooling hole between every two immediately adjacent turbulators, such that when the cooling air is conveyed into the serpentine cooling passage to cool the gas turbine blade the cooling air also exits from said another film cooling hole between every two immediately adjacent turbulators, wherein a width of each of the turbulators is e, and a distance between a downstream side of each of the turbulators and a center of a respective said another film cooling hole is d, with said respective said another film cooling hole being positioned such that the following relationship results.

* * * * *